US005179980A

United States Patent [19]

Hubner et al.

[11] Patent Number: 5,179,980

[45] Date of Patent: Jan. 19, 1993

[54] WEFT YARN BRAKE WITH LOGIC CIRCUIT CONTROL

[75] Inventors: Oskar Hubner, Radolfzell; Rudolf Stauner, Konstanz, both of Fed. Rep. of Germany

[73] Assignee: Sulzer Brothers Limited, Winterthur, Switzerland

[21] Appl. No.: 754,571

[22] Filed: Sep. 4, 1991

[30] Foreign Application Priority Data

Sep. 10, 1990 [CH] Switzerland ..... 02935/90

[51] Int. Cl.[5] ..... D03D 47/34

[52] U.S. Cl. ..... 139/450; 139/194; 139/185; 139/453; 242/149; 112/255

[58] Field of Search ..... 139/450, 194, 453, 452, 139/185; 242/147 R, 149; 112/255; 66/134, 140 R, 142, 145 R; 188/65.1, 65.2, 65.3, 65.4, 65.5

[56] References Cited

U.S. PATENT DOCUMENTS

| | | | |
|---|---|---|---|
| 4,300,465 | 11/1981 | Tsuboi | 112/255 |
| 4,431,036 | 2/1984 | Schnyder . | |
| 4,674,544 | 6/1987 | Hintsch | 139/185 |
| 4,875,506 | 10/1989 | Gacsay et al. | 139/450 |
| 4,962,796 | 10/1990 | Grimm et al. | 139/450 |

FOREIGN PATENT DOCUMENTS

| | | |
|---|---|---|
| 0294323 | 12/1988 | European Pat. Off. . |
| 0357975 | 3/1990 | European Pat. Off. . |
| 0384502 | 8/1990 | European Pat. Off. . |
| 2568595 | 8/1986 | France . |

*Primary Examiner*—Andrew M. Falik
*Attorney, Agent, or Firm*—Kenyon & Kenyon

[57] ABSTRACT

A yarn brake which can be used in projectile looms and rapier looms is actuated by a stepping motor with the rotational movement of a drive shaft of the stepping motor being converted to a linear movement of the braking member of the yarn brake.

9 Claims, 3 Drawing Sheets

WEFT YARN BRAKE WITH LOGIC CIRCUIT CONTROL

Figure 2A:
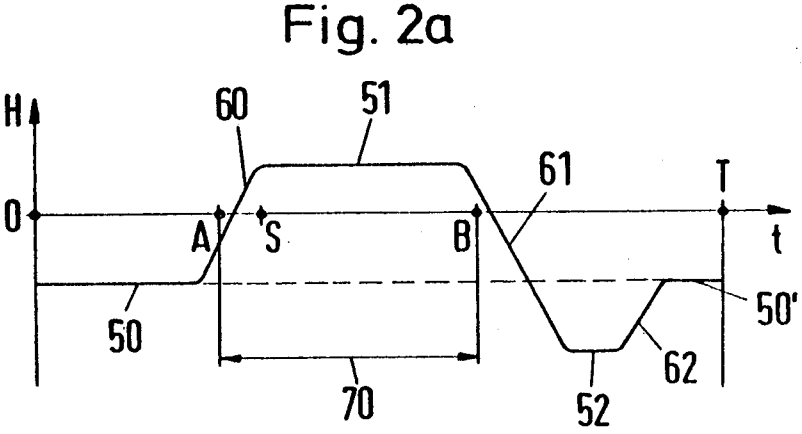

This invention relates to a yarn brake for a loom. More particularly, this invention relates to a yarn brake which can be used in a projectile loom and in a rapier loom.

As is known, projectile looms have been provided with yarn tensioners, each of which has been embodied by a yarn brake and a draw-back or tensioning lever, disposed between a yarn package and a shed. A yarn brake which has proved very satisfactory in practice has a resilient metal band which is tensioned by means of a spring and a braking member having, for instance, a spoon-shaped braking part between which a yarn can be clamped with the yarn being pressed on to the brake band. Since the band is resilient, partial braking is possible in which the yarn can continue to be drawn through between the two braking components of the yarn brake against friction. The braking member is moved mechanically by way of a linkage actuated by means of a cam shaft. Yarn brakes of this type are described in U.S. Pat. No. 4,431,036.

Electromagnetically controlled yarn brakes are also known in which one or more braking members are moved by electromagnets or in which a gap between a ferromagnetic strip and a fixed companion surface is acted on by means of electromagnets, such as described in EP-A-0 294 323. The advantage of such a yarn brake is that the braking force can be controlled by means of a logic circuit arrangement and it is a simple matter to adapt the braking power, for example, to cope with changing yarn quality, particularly in connection with article changes.

Other yarn brakes have also been described in EPA 0 357 975; EPA 0 384 502 and French Patent 2,568,595.

The heaviest demands on yarn brake control occur during the phase of picking or shooting the projectile. At this time, the yarn brake gap must stay closed until the transfer of yarn to the projectile. The yarn brake gap must then be opened after picking when weft yarn is fed in. The yarn brake of high-speed looms must release within a few milliseconds. Conventional cam actuators cannot provide this function; to do so the cam actuators would have to be of a lightweight and very expensive construction. Reliable operation of the brake is difficult even with electromagnetic control.

A problem solvable by means of rapid control yarn brakes is also present in the case of high-speed rapier looms in which a giver rapier introduces a weft yarn as far as the center of a shed where the weft yarn is taken over by a taker rapier. After acceleration of the weft yarn by the giver rapier, during which acceleration the yarn brake must be off, a delay occurs towards the transfer position at the center of the shed in which, because of its mass inertia, the weft yarn may run up on or overtake the giver rapier. The yarn brake must be applied in order to keep the weft yarn tensioned during the delay phase. However, the weft yarn must be released immediately after transfer to the taker rapier. This calls for a yarn brake which responds rapidly during yarn transfer.

Accordingly, it is an object of the invention to provide a yarn brake for a high-speed loom which is capable of rapid action.

It is another object of the invention to be able to use a conventional type of yarn brake for high-speed looms.

It is another object of the invention to obtain high reaction times for a yarn brake in a high-speed loom.

Briefly, the invention provides a yarn brake for a loom which is comprised of a brake band and a braking member for pressing a weft yarn against the brake band. In accordance with the invention, an actuating motor having a rotatable shaft is provided with a means connected between the shaft and the braking member for driving the braking member with a linear movement in response to rotation of the shaft. In addition, a triggering and logic circuit arrangement is provided for driving the motor.

The motor may be in the form of a stepping motor having a drive shaft together with a permanent magnet secured thereto rotated through a stationary ring of small electromagnets which are arranged at uniform angular intervals of, for example, 7.5° and which are energizable sequentially at time intervals of, for example, 2.5 milliseconds. A stepping motor of this kind enables the brake to release in approximately 10 milliseconds.

In one embodiment, the braking member is pivotally mounted and the means for converting the rotational movement of the drive shaft to a linear movement of the braking member is constituted by a lever secured to the shaft for rotation therewith and a link pivotally connected to the lever and to the braking member. In addition, a sensor may be provided for recording a reference position of the shaft with the sensor being operatively connected to the triggering and logic circuit arrangement to deliver a signal thereto indicative of the reference position.

In another embodiment, the shaft is a screw-threaded shaft which is coupled to the braking member while the means for converting the rotational movement of the shaft to a linear movement of the braking member includes a stationary sleeve slidably guiding the braking member therein and means to prevent rotation between the sleeve and the braking member.

Figure 2B:
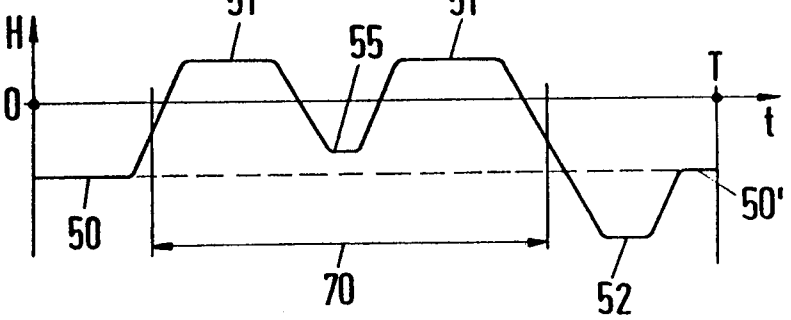
Figure 1:
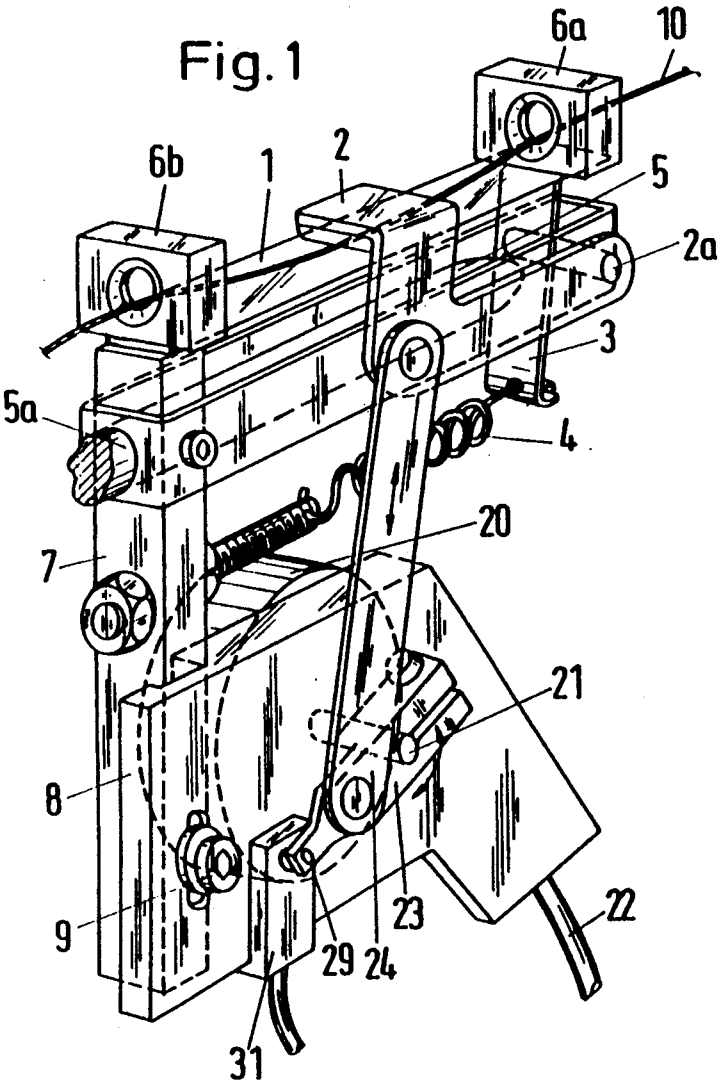
Figure 3A:
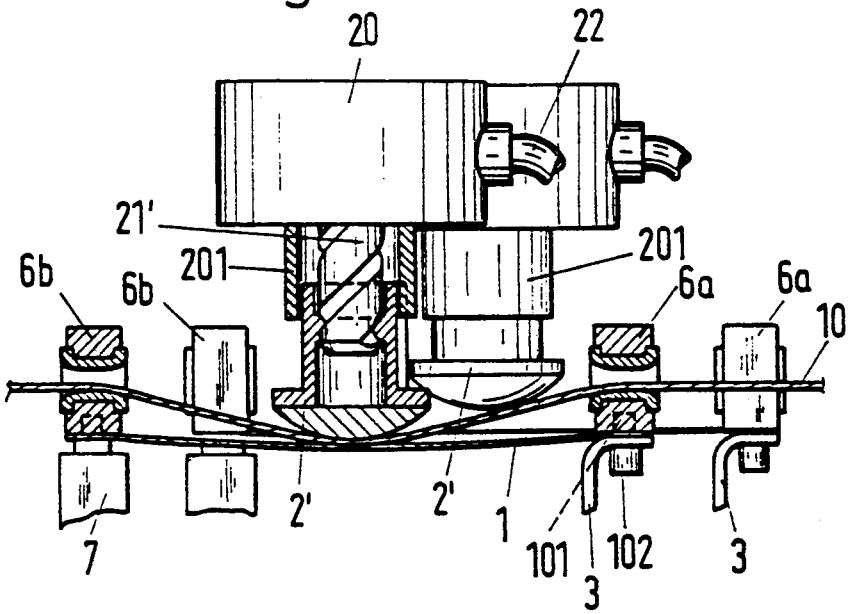
Figure 3B:
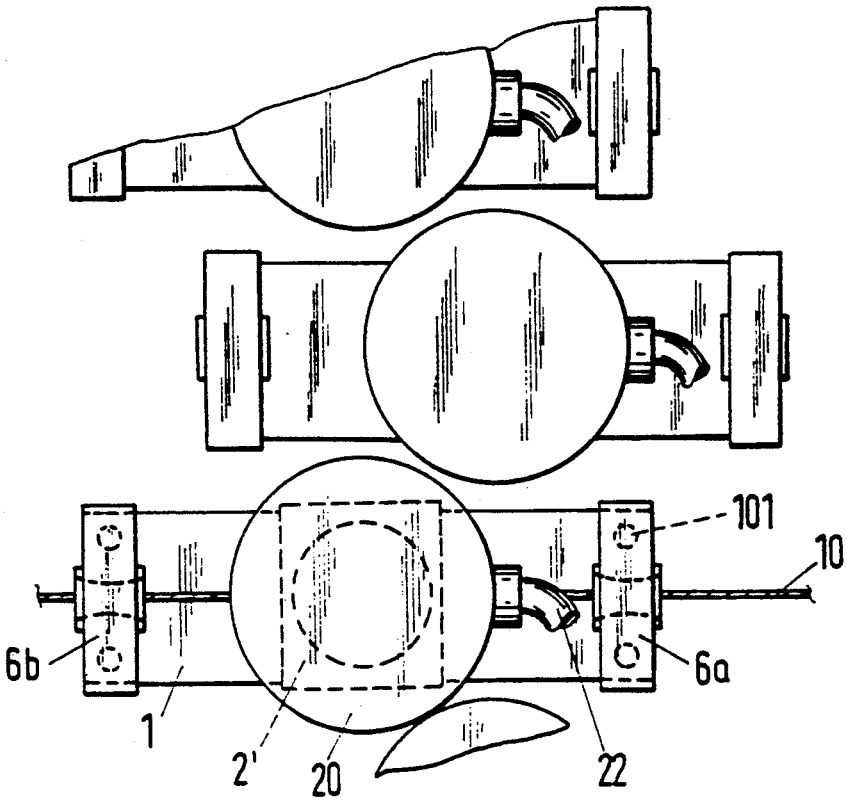
Figure 4A:
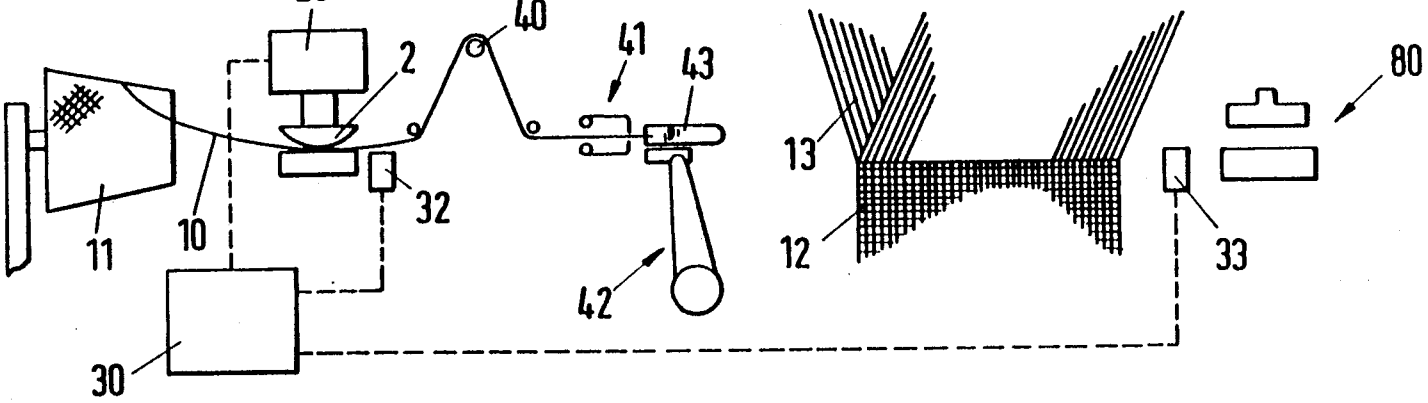
Figure 4B:
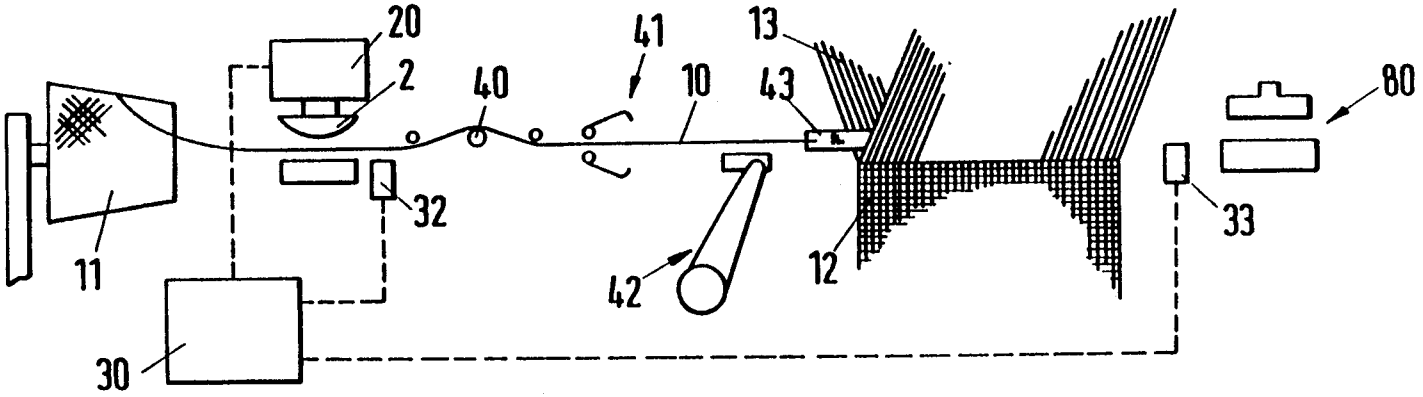

These and other objects and advantages of the invention will become more apparent from the following detailed description taken in conjunction with the accompanying drawings wherein:

FIG. 1 illustrates a perspective view of a yarn brake constructed in accordance with the invention;

FIG. 2*a* graphically illustrates a position of a braking member during a weaving cycle of a projectile loom incorporating the yarn brake of FIG. 1 in accordance with the invention:

FIG. 2*b* graphically illustrates a timing curve for a yarn brake according to the invention in a rapier loom;

FIG. 3*a* illustrates a view of a series of yarn brakes, partially in cross-section, in a loom;

FIG. 3*b* illustrates a plan view of the yarn brakes of FIG. 3*a*;

FIG. 4*a* diagrammatically illustrates a view at the instant of yarn transfer to a projectile of those components of a projectile loom which are important to a picking operation and which employ a yarn brake in accordance with the invention; and FIG. 4*b* diagrammatically illustrates a view similar to FIG. 4*a* shortly after picking of the projectile.

Referring to FIG. 1, the yarn brake includes a brake band 1 and a braking member 2 for pressing a weft yarn 10 against the brake band 1. As indicated, the braking member 2 is pivotally mounted at one end on a pivot 2*a*. In addition, a lever-like metal member 3 is secured to the brake band 1 in order to enable the brake band 1 to be tensioned by the use of a spring 4 secured to a vertical support beam 7. A horizontal pin-like rod 5 has an apex to which the metal member 3 is tiltably attached and is connected at an opposite end 5*a* to other loom components (not shown) such as a weft yarn monitor and a supporting frame. Guides 6*a*, 6*b* are provided for guiding the weft yarn 10 with one guide 6*b* secured directly to the vertical support beam 7 and the other guide 6*a* being secured to the metal member 3.

In addition, a support plate 8 is secured to the vertical support beam 7 and is vertically adjustable relative to the beam 7 by means of a screw 9. The support plate 8, in turn, carries an actuating motor 20, such as a stepping motor, having a rotatable drive shaft 21. A suitable connecting cable 22 extends from the motor 20 and connects with a triggering and logic circuit arrangement 30 (see FIG. 4*a*) which serves as a means to actuate the motor 20

In addition, a means is connected between the drive shaft 21 and the braking member 2 for driving the braking member 2 with a linear movement in response to rotation of the shaft 21. As indicated, this means includes a lever 23 which is secured to the shaft 21 for rotation therewith and a link 24 which is pivotally connected to the lever 23 and to the braking member 2. A small permanent magnet 29 is also disposed on the lever 23 and cooperates with an inductive sensor 31 on the support plate 8 to deliver a signal indicative of a reference position of the motor 20. This sensor 31 is also operatively connected to the triggering and logic circuit arrangement to deliver the signal thereto.

The logic circuit arrangement 30 may have a memory which contains a control program for each yarn brake which produces a linear movement curve optimally adapted, for example, to the yarn properties of the weft yarn.

The curve of FIG. 2*a* shows the positions in time taken up by the braking surface of the braking member 2 (instead of the time t, the phase of the loom cyclic (degrees of loom rotation) is used as a variable and can be ascertained by a crank angle pickup on the loom main shaft). The period length T of the weaving cycle, corresponding to 360° of loom rotation, is of the order of magnitude of 200 milliseconds. The movement H of the braking member 2 is positive when the gap is open—i.e., the brake is in the released state. Since the brake band 1 is resilient, the movement H can be negative. In the case of a slightly negative movement H, the yarn can still be drawn through between the band 1 and the braking member 2.

At the start and end of the weaving cycle, the yarn brake is in the partial braking position, corresponding to portions 50 and 50' of the curve. During the time interval 70 of projectile flight, the yarn brake is in the released state except for a short initial phase (curve portion 51). The opening of the yarn brake, corresponding to curve protion 60, occurs within approximately 10 to 15 milliseconds. Yarn braking, corresponding to curve portion 61, is less abrupt than brake release in order to avoid damaging the weft yarn and the braking force increases to a full braking state represented by curve portion 52. After a short period of full braking, partial braking resumes, corresponding to curve portion 62. Further details of the curve of yarn brake movement in projectile looms will be described hereinafter with reference to FIGS. 4*a* and 4*b*.

The yarn brake can, for example, be actuated without partial braking, in which event the state of the yarn brake changes merely between its fully applied position and yarn release.

The yarn brake movement curve for rapier looms which is shown in FIG. 2*b* and which can be provided by the yarn brake differs considerably from the curve of FIG. 2*a* by the s intermediate braking corresponding to curve portion 55 in FIG. 2*b*. As already described, during picking, corresponding to the time interval 70, and before yarn transfer from a giver rapier to a taker rapier, a brief brake application is made, whereafter the brake releases (curve portion 51').

Referring to FIGS. 3*a* and 3*b*, wherein like reference characters indicate like parts as above, each yarn brake may be constructed so that the operative movement of the braking member 2' is produced directly by way of a screw-threaded shaft 21'. In this case, the means for converting the rotation of the shaft 21' to a linear movement of the braking member 2' includes a stationary sleeve 201 which is mounted on the motor 20 to slidably guide the braking member 2' therein and means, such as a groove in the member 2' and a comb in the sleeve 201 to prevent rotation between the sleeve 201 and the braking member 2'. The yarn brake shown in the foreground is in the fully or partly braked state whereas the yarn brake in the background is in the released state.

As indicated in FIGS. 3*a* and 3*b*, the brake band 1 is fixed in the yarn guides 6*a*, 6*b* by means of studs or pins or the like 101 secured to the band 1, for example, by welding. The yarn guide 6*a* is secured, for example, by a screw 102 to the member 3 which transmits the spring force.

The motor 20 of each embodiment is in the shape of a flat cell having a diameter of approximately 60 millimeters and a height of approximately 30 millimeters. This shape ensures compactness when a number of yarn brakes of the kind shown in FIG. 1 operate in parallel. The yarn brakes of FIG. 3*a* can also be arranged compactly if staggered relative to one another as shown in FIG. 3*b*.

The zero position of the movement curve, corresponding to H=0, can readily be varied in the embodiment of FIG. 1 by the plate 8 being shifted along the beam 7. Correspondingly, in the embodiment shown in FIG. 2*a*, the zero position can be varied by shifting the motor 20 vertically relatively to a support construction (not shown).

Further explanations and amplifications relating to projectile looms will now be given with reference to FIGS. 4*a* and 4*b*. FIGS. 4*a* and 4*b* illustrate the following components in diagrammatic form: a yarn package 11 containing the weft yarn 10; the yarn brake comprising the braking member 2 and the motor 20, the same being connected to the triggering and logic circuit arrangement 30; a tensioning lever 40 and a yarn giver 41; a strike lever 42 and a projectile 43; cloth 12 and a shed 13, a catching brake 80 for the projectile 43; a weft yarn monitor 32 at the exit of the yarn brake and a projectile monitor 33 on the catching side, the two monitors 32, 33 being connected to the circuit arrangement 30.

In the situation shown in FIG. 4*a*, the giver 41 is transferring the weft yarn 10 to the projectile 43 and the movement of the braking member 2 is beginning. At the instant of picking of the projectile 43, indicated by the time A in FIG. 2*a*, the tensioning lever 40 pivots from a draw-back position into a stretching position, the latter position being shown in FIG. 4*b*. After this pivoting moment, during which the yarn length stored in the yarn tensioner is released, the yarn brake must be off, for the accelerated projectile 43 is drawing the weft yarn 10 off the package 11 or off a weft accumulator (not shown) at full power. The weft yarn 10 experiences during this stage what is known as the stretching stroke, which occurs at the time S in the diagram of FIG. 2*a*. The yarn brake control must be so programmed that the curve portion 60 of FIG. 2*a* intercepts the abscissa between the positions A and S, i.e., within a time of not more than 15 milliseconds.

The projectile 43 is stopped in the yarn brake 80 at the time B. The yarn brake 2 simultaneously stops the movement of the weft yarn 10. The effect of full braking, represented by the curve portion 52, is that during the subsequent drawback movement of the lever 40, weft yarn 10 is fed or drawn only from the shed 13 and not from the package 11 (or from a weft accumulator which is not shown).

The arrival time of the projectile 43 can of course be monitored by means of a sensor 33 on the catching side in order to control yarn tension and, therefore, flight duration by action on the initial conditions of shooting. The logic circuit arrangement 30 enables the yarn brake to provide a satisfactory control of this kind.

In the yarn brake embodiments described, the multiple possibilities for constructing the brake band 1 and the braking member 2 have not been described in great detail. However, the braking member 2 can take the shape not of a spoon, but, for example, of a double finger or of a metal band loop.

The invention thus provides a yarn brake which is capable of rapid reaction. Further, the invention provides a yarn brake which can be readily employed in a projectile loom as well as in a rapier loom.

What is claimed is:

1. A yarn brake for a loom comprising:

a brake band including a resilient metal band which is tensioned by means of a spring;

a braking member for pressing a weft yarn against said brake band;

an actuating motor having a rotatable shaft;

means connected between said shaft and said member for driving said braking member with a linear movement in response to rotation of said shaft; and a triggering and logic circuit arrangement for driving said motor.

2. A yarn brake as set forth in claim 1 wherein said motor is a stepping motor.

3. A yarn brake as set forth in claim 1 which further comprises a sensor for recording a reference position of said shaft, said sensor being operatively connected to said circuit arrangement to deliver a signal thereto indicative of said reference position.

4. A yarn brake as set forth in claim 1 wherein said braking member is pivotally mounted and said means includes a lever secured to said shaft for rotation therewith and a link pivotally connected to said lever and to said braking member.

5. A yarn brake as set forth in claim 4 which further comprises a permanent magnet on said lever and an inductive sensor responsive to said permanent magnet to record a reference position of said shaft, said sensor being operatively connected to said circuit arrangement to deliver a signal thereto indicative of said reference position.

6. A yarn brake as set forth in claim 1 wherein said shaft is a screwthreaded shaft coupled to said braking member and said means includes a stationary sleeve slidably guiding said braking member therein and means to prevent rotation between said sleeve and said braking member.

7. A projectile loom comprising means for picking a projectile through a shed of warp yarns; and a yarn brake for braking a weft yarn trailing from said projectile, said yarn brake comprising a brake band, a braking member for pressing a weft yarn against said brake band, an actuating motor having a rotatable shaft, means connected between said shaft and said member for driving said braking member with a linear movement in response to rotation of said shaft and a triggering and logic circuit arrangement for driving said motor.

8. A projectile loom as set forth in claim 7 further comprising a monitor for detecting arrival of a projectile from said shed, said monitor being operatively connected with said circuit arrangement to deliver a signal thereto indicative of the arrival of a projectile thereat.

9. A rapier loom comprising a giver rapier for carrying a weft yarn into a shed of warp yarns;

a taker rapier for receiving a weft yarn from said giver rapier in said shed; and a yarn brake for braking a weft yarn during transfer between said rapiers, said yarn brake comprising a brake band, a braking member for pressing a weft yarn against said brake band; an actuating motor having a rotatable shaft, means connected between said shaft and said member for driving said braking member with a linear movement in response to rotation of said shaft, and a triggering and logic circuit arrangement for driving said motor.

* * * * *

UNITED STATES PATENT AND TRADEMARK OFFICE

CERTIFICATE OF CORRECTION

PATENT NO. : 5,179,980

DATED : January 19, 1993

INVENTOR(S) : Hubner, et al

It is certified that error appears in the above-indentified patent and that said Letters Patent is hereby corrected as shown below:

Column 3, line 45, change "ope" to --open--;
line 46, delete "n";
line 57, change "protion" to --portion--.

Column 4, line 6, delete "s".

Signed and Sealed this

Nineteenth Day of April, 1994

Bruce Lehman

*Attest:*

BRUCE LEHMAN

*Attesting Officer*

*Commissioner of Patents and Trademarks*